US005687840A

United States Patent [19]

Sherman

[11] Patent Number: 5,687,840

[45] **Date of Patent: *Nov. 18, 1997**

[54] ATTRACTIVE HANGING RECEPTACLE FOR PLASTIC BAGS

[76] Inventor: Victoria Sherman, 3116 Alhambra Cir., Coral Gables, Fla. 33134

[ * ] Notice: The term of this patent shall not extend beyond the expiration date of Pat. No. 5,487,467.

[21] Appl. No.: 548,645

[22] Filed: Oct. 26, 1995

Related U.S. Application Data

[63] Continuation-in-part of Ser. No. 248,665, May 25, 1994, Pat. No. 5,487,467.

[51] Int. Cl.[6] ..... B65D 83/00

[52] U.S. Cl. ..... 206/216; D9/311; 206/457; 206/554; 221/303; 383/24; 383/75; 383/86; 383/97

[58] Field of Search ..... D3/234–236; D9/305, D9/311, 318; D21/167–168, 171, 175, 180, 186, 189, 190; 206/554, 457; 221/303; 446/72–74, 268, 364, 372, 373, 385, 391

[56] References Cited

U.S. PATENT DOCUMENTS

| | | | |
|---|---|---|---|
| D. 48,776 | 3/1916 | Dieneman | D3/236 |
| D. 48,947 | 4/1916 | Pfunder | D3/236 |
| D. 53,034 | 3/1919 | Finn | D3/235 |
| D. 60,920 | 4/1922 | Schumucker et al. | D3/236 |
| D. 61,198 | 7/1922 | Kerby | D21/186 |
| D. 74,169 | 1/1928 | Cohen | D3/236 |
| D. 87,640 | 5/1932 | Lopez | D9/311 |
| D. 143,580 | 1/1946 | Cohen | D3/236 |
| D. 181,304 | 10/1957 | Mann | D3/236 |
| 1,210,892 | 1/1917 | Borchmann | 446/74 |
| 1,407,165 | 2/1922 | Pajeau | 446/268 |
| 1,437,467 | 12/1922 | Dykman | 446/74 |
| 1,583,284 | 5/1926 | Dykman | 446/74 |
| 1,775,796 | 9/1930 | Williams | 383/86 |
| 2,129,654 | 9/1938 | Dennis | 446/74 |
| 4,988,216 | 1/1991 | Lyman | 383/86 |
| 5,042,687 | 8/1991 | McKinley | 221/311 |
| 5,285,927 | 2/1994 | Pruitt | 221/303 |
| 5,341,933 | 8/1994 | Willows | 206/554 |
| 5,487,467 | 1/1996 | Sherman | 206/554 |

*Primary Examiner*—Jimmy G. Foster
*Attorney, Agent, or Firm*—Malloy & Malloy, P.A.

[57] ABSTRACT

A receptacle for plastic shopping bags and like articles comprising an upper member having the general structure and appearance of an upper portion of a doll body, whether a human figure or an animal figure, and a lower element structured and disposed for receiving articles therein. The lower element, which has the general shape and configuration of a skirt, is attached to the upper member and extends downwardly therefrom. The lower element defines a cavity in which plastic shopping bags can be stored, and also has an opening in communication with the cavity that is sized and configured to allow passage therethrough of a plastic shopping bag. The receptacle includes means for suspending the receptacle from a vertical surface, positioned on the upper member so as to substantially prevent the upper member from falling forward and thereby allow primarily a full display of both the upper member and lower element when suspended. The receptacle may also include means structured and disposed on the lower element for either partially or fully closing the opening.

28 Claims, 2 Drawing Sheets

ATTRACTIVE HANGING RECEPTACLE FOR PLASTIC BAGS

The present application is a continuation-in-part application of previously filed, application having Ser. No. 08/248,665 filed on May 25, 1994, U.S. Pat. No. 5,487,467.

BACKGROUND OF THE INVENTION

1. Field of the Invention

This invention relates generally to a receptacle for plastic shopping bags, and in particular to an attractive, easy to use receptacle for plastic shopping bags in the shape of a human doll figure or an animal doll figure.

2. Description of the Related Art

It is presently common practice for grocery stores, among other types of stores, to utilize small plastic bags for the purpose of bagging customers' purchases upon checkout instead of the large brown paper bags used in the past. Presumably, store owners follow this practice because plastic bags are less expensive than paper bags, especially given the rising costs of paper, and are thought to be more convenient to carry. Consequently, many people accumulate plastic shopping bags and find other uses for them such as for lining small trash cans, disposing of cat litter, etc.. Unfortunately, it has become public knowledge that when plastic shopping bags are disposed of, they typically end up in a garbage dump where they do not disintegrate rapidly, unlike paper bags. Rather, plastic bags take years upon years to decompose and in many cases, choke out sunlight to soil, plant life, etc. and in general, become hazardous to the environment. For these reasons, many supermarkets encourage the recycling of plastic shopping bags by offering recycling bins at store locations where customers can deposit used plastic shopping bags instead of disposing of them, so as to avoid the environmental hazards associated therewith.

Those persons who return their plastic shopping bags for recycling usually tend to amass a large number of them before doing so. People generally store these accumulated plastic bags in a haphazard manner, for example, by folding or crumpling them and placing them in a drawer in the kitchen. As another example, some people accumulate numerous folded and crumpled plastic bags within one plastic shopping bag utilized as a receptacle, which given its bulkiness when filled, often remains on a kitchen counter top where it is unsightly and/or in a pantry where it takes up valuable storage room. As a result, there is a need in the art for a suitably convenient means for storing plastic shopping bags for subsequent use or return to the supermarket for recycling. There is also a need in the art to provide an attractive appearance to any such means for storing plastic shopping bags. For instance, it is generally recognized that decorative figures such as dolls appeal to many people, primarily women and children. While the related art describes receptacles or article holders combined with decorative figures, it is believed that no such decorative figures exist in combination with a receptacle for storing plastic shopping bags.

SUMMARY OF THE INVENTION

The present invention is directed toward solving the specific needs associated with providing a receptacle for storing plastic shopping bags and towards providing an attractive decorative figure-shaped receptacle for the plastic shopping bag receptacle. In accordance with one aspect of the present invention, there is provided a receptacle for plastic shopping bags and like articles comprising an upper member having the general structure and appearance of an upper portion of a doll body, the doll body comprising either a human figure or an animal figure, and a lower element structured and disposed for receiving articles therein. The lower element, which has the general shape and configuration of a skirt, is attached to the upper member and extends downwardly therefrom. The lower element defines a cavity in which plastic shopping bags can be stored, and also has an opening in communication with the cavity that is sized and configured to allow passage therethrough of a plastic shopping bag. The receptacle of this invention preferably includes means for suspending the receptacle from a vertical surface, which suspending means are positioned on the upper member so as to substantially prevent the upper member from falling forward and thereby allow primarily a full display of both the upper member and lower element when the receptacle is suspended. The receptacle preferably includes means structured and disposed on the lower element for either partially or fully closing the opening.

It is an object of the present invention to provide an easy to use receptacle for conveniently storing plastic shopping bags and like articles.

It is a further object of this invention to provide an attractive receptacle in the general shape of a decorative human doll figure for storing plastic shopping bags and like articles.

Yet another object of this invention to provide an attractive receptacle in the general shape of a decorative animal doll figure for storing plastic shopping bags and like articles.

Still another object of the present invention is to provide an attractive receptacle for storing plastic shopping bags and like articles which can be conveniently suspended for display of the attractive receptacle and for use of the receptacle.

Yet another object of the present invention is to provide a receptacle for storing plastic shopping bags and like articles which also includes a holding member for a dish towel.

BRIEF DESCRIPTION OF THE DRAWINGS

The invention will be better understood after reading the following detailed description of the presently preferred embodiment thereof in which.

DETAILED DESCRIPTION OF THE PREFERRED EMBODIMENT

Figure 1:
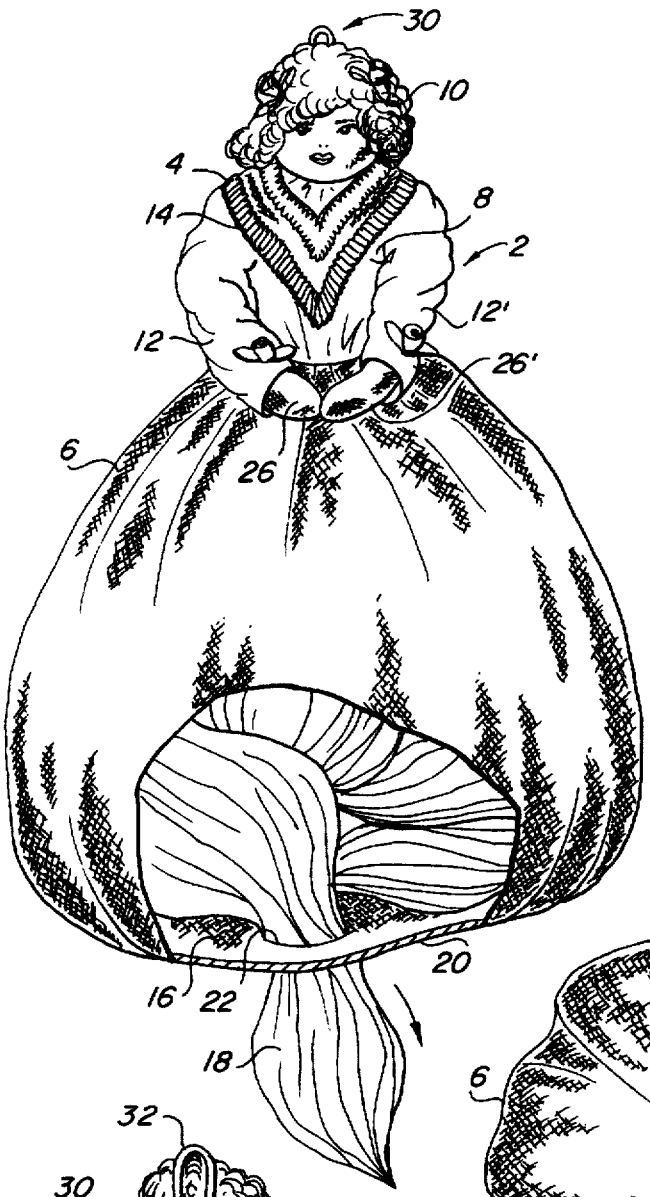
FIG. 1 illustrates a front perspective view and a partial cross-sectional front view of one embodiment of the receptacle of the present invention.

Shown throughout FIGS. 1 through 8, there is shown an attractive hanging receptacle according to the present invention, generally designated 2, which is structured and configured for removably receiving plastic shopping bags and similar lightweight articles. As shown throughout the drawings, receptacle 2 includes an upper member 4 and a lower element 6, perhaps best illustrated in FIG. 1. In a first preferred embodiment and as shown in FIGS. 1–6, upper member 4 is shaped and configured as the upper portion of a human doll body extending generally from the waist upwards, and preferably includes a torso 8, a head 10, and a pair of arms 12, 12'. Most preferably, the upper portion has the general appearance of a female doll body although it will be appreciated that a male doll body would work suitably as well. In another preferred embodiment illustrated in FIG. 8, upper member 104 is shaped and configured as the upper portion of an animal doll body, such as a pig, although it will be understood that upper member 104 could be configured to represent enumerable other types of animals, such as a cow, horse, lamb, bird, fish, etc.. In this embodiment as well, upper member 104 extends generally from the waist upwards, and preferably includes a torso 108, a head 110, and a pair of arms 112, 112'.

Figure 3:
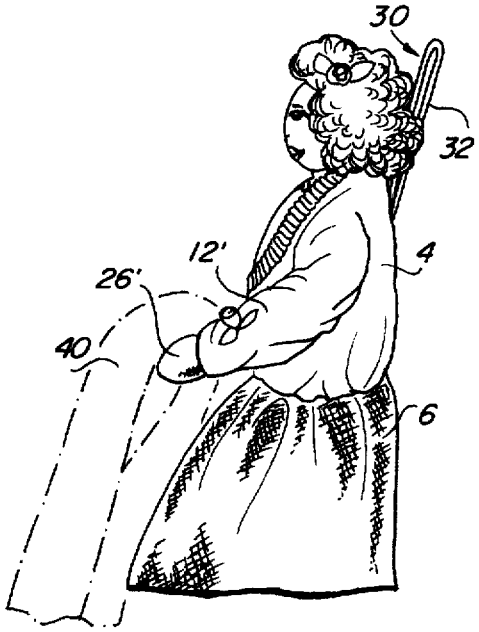
FIG. 3 illustrates a partial side view of the receptacle showing a towel being retained by the holding member.
Figure 2:
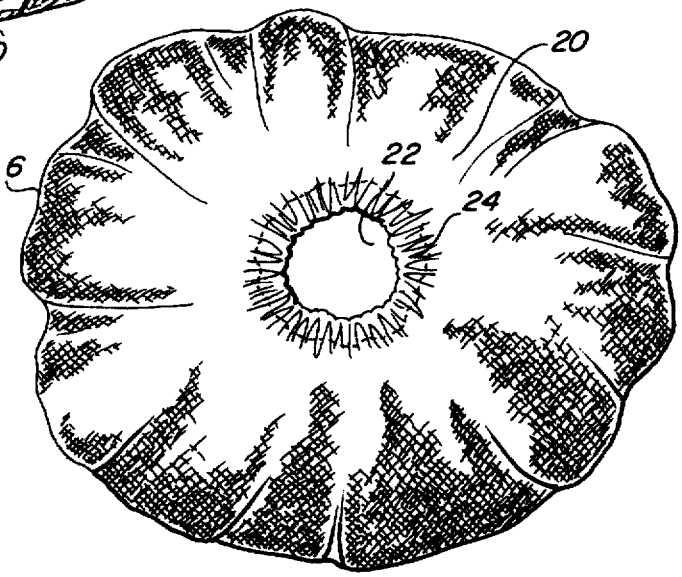
FIG. 2 illustrates a bottom view of the receptacle shown in FIG. 1.
Figure 7:
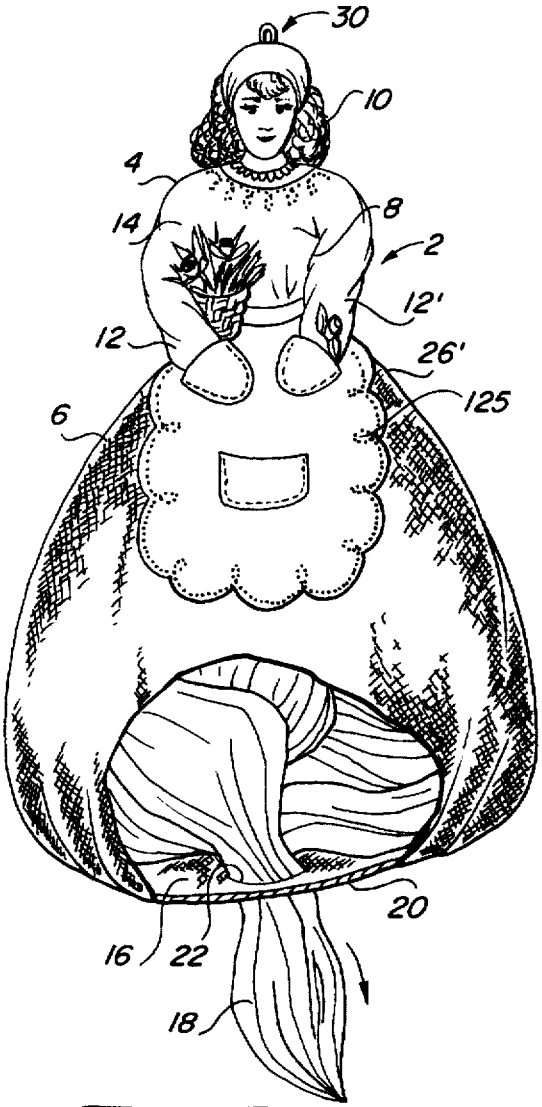
FIG. 7 illustrates another embodiment of the receptacle according to this invention wherein the receptacle also has the general structure and appearance of a female doll figure with the head portion being made of porcelain.
Figure 8:
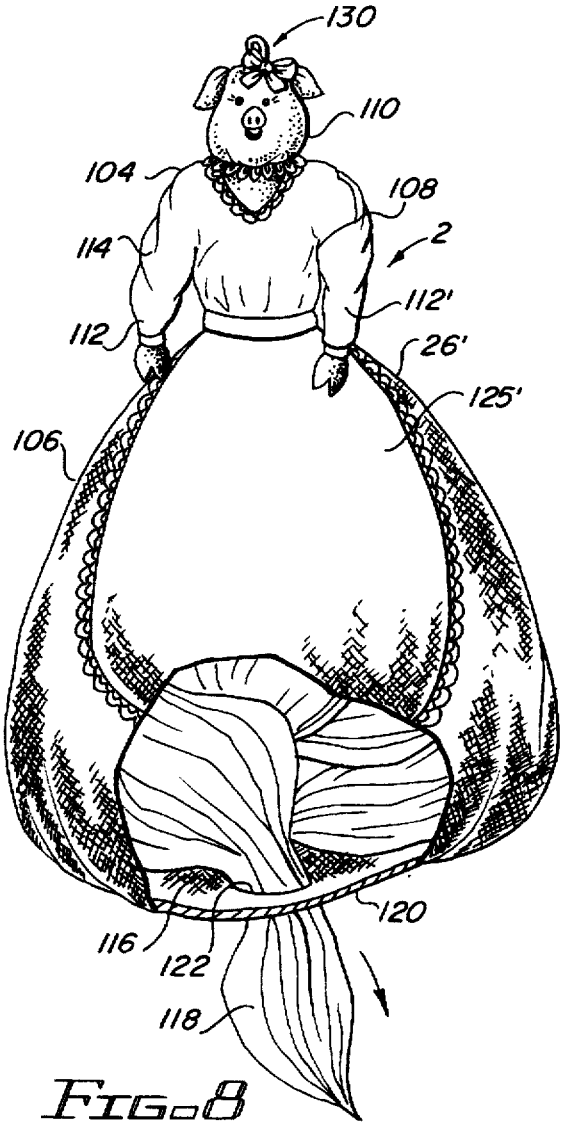
FIG. 8 illustrates an alternative embodiment of the receptacle of the present invention wherein the receptacle has the general structure and appearance of an animal doll figure.

In the preferred embodiments, upper member 4, 104, includes an outer shell constructed of cloth which defines torso 8, 108 and arms 12, 12', 112, 112' of the doll body and/or animal body, and an inner support element disposed within torso 8, 108 formed of cotton batting, foam rubber or any other suitable resilient material. If desired, arms 12, 12', 112, 112' may also include an inner support element disposed therein also formed of cotton batting, foam rubber or any other suitable resilient material. Head 10, 110 may be constructed of wood, plastic, or even cloth stuffed with support material, and is attached to torso 8, 108 by gluing, sewn stitching or any other conventional means of attachment as shown in FIGS. 1 and 3. Head 10 is preferably attractively decorated with the face of a woman wearing makeup, and may include a hairpiece thereon. In a more preferred embodiment and as illustrated in FIG. 7, head 10 may even be constructed of porcelain so as to offer a fine, high quality and beautifully faced doll, and in addition to a hairpiece, may include other ornamental and decorative items such as flowers, a hat, bandanna, etc.. As shown throughout the Figures, in the preferred embodiment, upper member 4, 104 is provided with an outer garment 14, 114 constructed preferably of fabric material, which may be a separate blouse 14 as shown in FIG. 1 or the upper section of a long dress 114 as shown in FIG. 8. Outer garment 14, 114 may be securely connected to upper member 4, 104 preferably at the Juncture of torso 8, 108 and head 10, 110.

Referring now to FIGS. 1 through 6, lower element 6 has the general shape and configuration of a long skirt which extends downwardly from upper member 4. Additionally, lower element 6 may be constructed of any suitable material for containing plastic bags and like lightweight articles therein, and in the preferred embodiment is constructed of fabric material and integrally formed with outer garment 14 of upper member 4 as the skirt portion of a long dress. It will be appreciated, however, that lower element 6 may be a separate skirt that is securely attached to outer garment 14 or upper member 4 by any conventional means of attachment such as sewing. The foregoing is also true of the lower element on the other embodiments. It will also be appreciated that lower element 6 may include an additional layer of fabric, attached thereto for decorative purposes, such as to provide an apron 125, 125' as illustrated in FIGS. 7 and 8. Further, as shown in the Figures, the skirt, in one preferred embodiment, may have a relatively narrow top region such that the skirt diverges to a relatively wide bottom region.

Lower element 6 defines a cavity 16 in which a plastic bag 18 may be removably received, and in the preferred embodiment has a bottom zone 20 defining an opening 22 which is sized and configured to allow passage therethrough of plastic bag 18. It will be understood from the figures that opening 22 is most preferably located at the bottom of zone 20 so as to not detract from the attractive skirt and general decorative appearance of the receptacle 2, may preferably be entirely within a lower half of the lower element, as shown in the drawings, and may preferably be smaller than the bottom region of the lower element such that a material of the bottom region converges to the opening. In one embodiment not shown, opening 22 may be sized just large enough to allow passage therethrough of plastic bag 18 while at the same time being sized small enough so as to contain plastic bag 18 within cavity 16 after being received therein. In the preferred embodiment of the invention, closure means are provided for releasably closing opening 22, either partially or fully, so as to securely captivate plastic bag 18 within cavity 16. In one preferred embodiment illustrated in FIG. 2, an expandable elastic band 24 is sewn within bottom zone 20 in surrounding relation to opening 22 so as to effect a partial closure of opening 22. In this partially closed condition, opening 22 is sized so as to prevent plastic bag 18 from falling out of cavity 16, and requires the user to stretch elastic band 24 and enlarge opening 22 in order to insert plastic bag 18 into, or remove plastic bag 18 from, cavity 16 through opening 22. In other preferred embodiments shown in FIGS. 4 and 5, respectively, hook and loop fastening material 34 or a zipper 36 may be provided for completely yet releasably closing opening 22. It will be appreciated by those skilled in the art, however, that any suitable means for effecting a partial or complete closure of opening 22 can be utilized, such as snap fasteners or a drawstring. The foregoing is also true of the lower element on the other embodiments illustrated in FIGS. 7 and 8.

Figure 6:
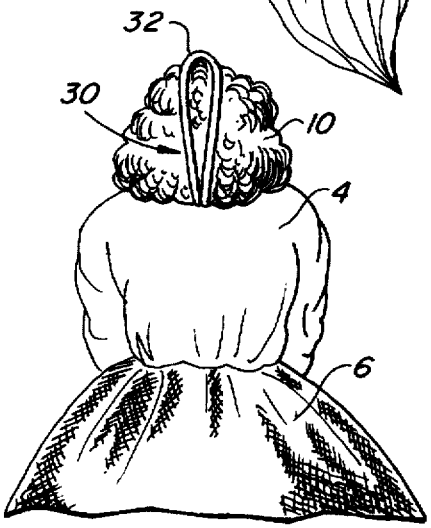
FIG. 6 illustrates a partial rear view of the receptacle shown in FIG. 1 and illustrating suspension means connected thereto.
Figure 4:
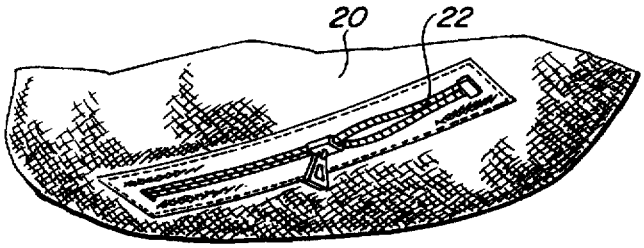
FIG. 4 illustrates one alternative embodiment of a closure means for completely closing the receptacle.
Figure 5:
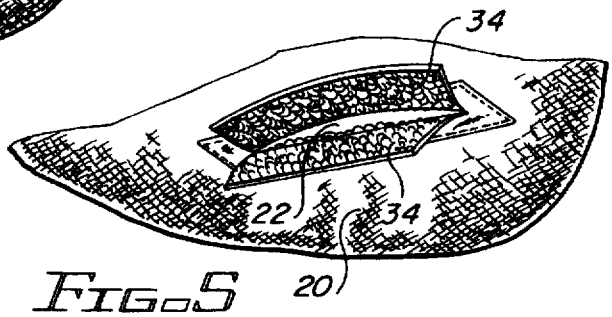
FIG. 5 illustrates another alternative embodiment of a closure means for completely closing the receptacle.

As perhaps best seen in FIGS. 3 and 6, the receptacle of this invention preferably includes means for suspending receptacle 2 from a surface such as an outer sidewall of a refrigerator. In the preferred embodiment, the suspension means 30 comprise a loop of string 32 connected to an external rear surface of upper member 4. It will be readily understood, however, that any other conventional means for suspending receptacle 2 may be used, such as a hook member, twist tie, etc.. It will also be appreciated that suspension means 30, 130 are most preferably operably connected to upper member 4 in a manner so that upon hanging receptacle 2 from a vertical surface, upper member 4 will not tilt forwardly. For this reason, suspension means 30 will be operably connected to an external rear surface of upper member 4 at any point above the receptacle's center of gravity and most preferably, generally adjacent the base of head 10 of upper member 4 as illustrated in FIG. 6. In this way, the suspension means will act to substantially prevent the upper member from falling forward and will thereby allow a full display of both the upper member and lower element when the receptacle is suspended. For convenient use of receptacle 2, loop 32 may be engaged with the hook end of a magnetic member that is securely attached to the sidewall or door of a refrigerator, so that receptacle 2 will be suspended vertically in an appropriate location for storage of plastic bag 18.

In an alternative embodiment shown in FIGS. 1 and 3, the distal ends 26, 26' of arms 12, 12' are connected together to form a holding member for a dish towel 40 or like item, although it will be recognized that the invention may omit this feature.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A receptacle for plastic bags and other like articles, comprising:

(a) an upper member having the general configuration and appearance of a doll and including a head, a material on said head having the appearance of hair and a torso;

(b) a lower element structured and disposed for receiving a plurality of plastic bags therein, said lower element having the general shape and configuration of a skirt including a relatively narrow top region and a relatively wide bottom region, said top region of said lower element being attached to said upper member and extending downwardly therefrom, said skirt diverging from said top region to said bottom region, said lower element defining a cavity therein;

(c) said lower element including an opening in communication with said cavity, said opening being smaller than said bottom region such that a material of said bottom region converges to said opening, said plurality of plastic bags being disposed in said cavity, said opening being structured and dimensioned to allow passage therethrough of at least one of the plastic bags and to contain the plastic bags within said cavity;

(d) a suspension member connected to said upper element at a rear exterior surface thereof, and generally corresponding said head, (e) said suspension member being structured to cooperate with a hook member disposed on a substantially vertical structure so as to suspend said receptacle therefrom with said upper member being prevented from falling forward when said receptacle is disposed in a suspended position.

2. A receptacle as recited in claim 1 wherein said upper portion of a doll body resembles a human doll figure.

3. A receptacle as recited in claim 1 wherein said upper portion of a doll body resembles an animal doll figure.

4. A receptacle as recited in claim 1 further comprising means structured and disposed on said lower element for partially closing said opening.

5. A receptacle as recited in claim 4 wherein said partial closure means comprises an elasticized element disposed about said opening in surrounding relation thereto, said elasticized element being in a normally contracted condition wherein said opening is partially closed.

6. A receptacle as recited in claim 5 wherein said elasticized element is an elastic band attached to said lower element at said opening.

7. A receptacle as recited in claim 1 further comprising means structured and disposed on said lower element for fully closing said opening.

8. A receptacle as recited in claim 7 wherein said full closure means comprises hook and loop fastening material disposed adjacent said opening.

9. A receptacle as recited in claim 7 wherein said full closure means comprises at least one male snap element and at least one corresponding female snap element disposed adjacent said opening.

10. A receptacle as recited in claim 7 wherein said full closure means comprises a zipper disposed adjacent said opening.

11. A receptacle as recited in claim 1 wherein said lower element is constructed of fabric material.

12. A receptacle as recited in claim 1 further comprising a garment disposed on an outer surface of said upper member, said garment being constructed of fabric material.

13. A receptacle as recited in claim 12 wherein said lower element is constructed of fabric material, and said garment and said lower element are integrally formed.

14. A receptacle as recited in claim 1 wherein said upper member includes an outer shell defining said upper portion and an inner support element disposed with said outer shell.

15. A receptacle as recited in claim 14 wherein said outer shell is constructed of cloth and said inner support element is constructed of a material from the group consisting of cotton batting and foam rubber.

16. A receptacle as recited in claim 13 wherein said upper portion of said doll figure resembles a female human figure and includes a head portion made of porcelain attached to an upper zone of said outer shell, said outer shell and said inner support element defining a torso, and said female human figure including a pair of arms connected to said torso.

17. A receptacle as recited in claim 1 wherein said upper member includes a head and a torso and said suspension means are secured to a lower region of said head, generally adjacent said torso.

18. A receptacle as recited in claim 11 wherein said lower element includes an additional layer of material having the appearance of an apron.

19. A receptacle as recited in claim 1 wherein said suspension member comprises a loop of string.

20. To be disposed on a protruding member disposed on a generally vertical structure, A receptacle for plastic bags and other like articles, comprising:

an upper member, said upper member having a general configuration and appearance of a doll and comprising: a head and a torso;

a lower element, said lower element defining a cavity therein;

said lower element being attached to said upper member and extending downwardly therefrom;

said lower member being structured and disposed to simultaneously define the general shape and configuration of a skirt and to receive and contain in a readily dispensable orientation a plurality of plastic bags in said cavity;

said lower element further including an opening defined entirely within a lower half thereof and disposed in communication with said cavity, dispensing means disposed at said opening of said lower element, said dispensing means being structured to contain said plurality of plastic bags within said cavity while allowing facilitated dispensing passage through said opening of at least one of the plastic bags upon affirmative removal by a user;

a suspension member coupled to said upper element, and said suspension member being structured and disposed to cooperate with the protruding member disposed on the substantially vertical structure so as to suspend said upper member and said lower member therefrom in an attractive, generally vertical orientation resembling said general configuration and appearance of said doll.

21. A receptacle for plastic bags and other like articles as recited in claim 20 wherein said dispensing means includes an elastic band disposed at said opening of said lower element and structured to substantially close said opening while still permitting dispensed removal of one of said plastic bags.

22. A receptacle for plastic bags and other like articles as recited in claim 20 wherein said dispensing means includes a zipper disposed at said opening of said lower element and structured to substantially close said opening while still permitting dispensed removal of one of said plastic bags.

23. A receptacle for plastic bags and other like articles as recited in claim 20 wherein said dispensing means includes a draw string disposed at said opening of said lower element and structured to substantially close said opening while still permitting dispensed removal of one of said plastic bags.

24. To be disposed on a protruding member disposed on a generally vertical structure, A receptacle for plastic bags and other like articles, comprising:

an upper member, said upper member having a general configuration and appearance of a doll and comprising: a head, and a torso;

a lower element, said lower element defining a cavity therein;

said lower element being attached to said upper member and extending downwardly therefrom;

said lower member being structured and disposed to simultaneously define the general shape and configuration of a skirt and to receive and contain in a readily dispensable orientation a plurality of plastic bags in said cavity;

said lower element further including a downwardly facing opening defined therein and disposed in communication with said cavity, dispensing means disposed at said opening of said lower element, said dispensing means being structured to contain said plurality of plastic bags within said cavity while allowing facilitated dispensing passage through said opening of at least one of the plastic bags upon affirmative removal by a user;

a suspension member coupled to said upper element, and said suspension member being structured and disposed to cooperate with the protruding member disposed on the substantially vertical structure so as to suspend said upper member and said lower member therefrom in an attractive, generally vertical orientation resembling said general configuration and appearance of said doll.

25. A receptacle for plastic bags and other like articles, comprising:

(a) an upper member having the general configuration and appearance of a doll and including a head, a material on said head having the appearance of hair and a torso;

(b) a lower element structured and disposed for receiving a plurality of plastic bags therein, said lower element having the general shape and configuration of a skirt including a relatively narrow top region and a relatively wide bottom region, said top region of said lower element being attached to said upper member and extending downwardly therefrom, said skirt diverging from said top region to said bottom region, said lower element defining a cavity therein;

(c) said lower element including an opening in communication with said cavity, said opening being smaller than said bottom region such that a material of said bottom region converges to said opening, a hook and loop fastening material disposed substantially at said opening and structured and dimensioned to allow passage therethrough of at least one of the plastic bags and to contain the plastic bags within said cavity;

(d) a suspension member connected to said upper element at a rear exterior surface thereof, and generally corresponding said head, and (e) said suspension member being structured to cooperate with a hook member disposed on a substantially vertical structure so as to suspend said receptacle therefrom with said upper member being prevented from falling forward when said receptacle is disposed in a suspended position.

26. A receptacle for plastic bags and other like articles, comprising:

(a) an upper member having the general configuration and appearance of a doll and including a head, a material on said head having the appearance of hair and a torso;

(b) a lower element structured and disposed for receiving a plurality of plastic bags therein, said lower element having the general shape and configuration of a skirt including a relatively narrow top region and a relatively wide bottom region, said top region of said lower element being attached to said upper member and extending downwardly therefrom, said skirt diverging from said top region to said bottom region, said lower element defining a cavity therein;

(c) said lower element including a downwardly facing opening in communication with said cavity, said opening being smaller than said bottom region such that a material of said bottom region converges to said opening, a zipper disposed substantially at said opening and structured and dimensioned to allow passage therethrough of at least one of the plastic bags and to contain the plastic bags within said cavity;

(d) a suspension member connected to said upper element at a rear exterior surface thereof, and generally corresponding said head, and (e) said suspension member being structured to cooperate with a hook member disposed on a substantially vertical structure so as to suspend said receptacle therefrom with said upper member being prevented from falling forward when said receptacle is disposed in a suspended position.

27. A receptacle for plastic bags and other like articles, comprising:

(a) an upper member having the general configuration and appearance of a doll and including a head, a material on said head having the appearance of hair and a torso;

(b) a lower element structured and disposed for receiving a plurality of plastic bags therein, said lower element having the general shape and configuration of a skirt including a relatively narrow top region and a relatively wide bottom region, said top region of said lower element being attached to said upper member and extending downwardly therefrom, said skirt diverging from said top region to said bottom region, said lower element defining a cavity therein;

(c) said lower element including an opening in communication with said cavity, said opening being smaller than said bottom region such that a material of said bottom region converges to said opening, an elastic band disposed substantially at said opening and structured and dimensioned to allow passage therethrough of at least one of the plastic bags and to contain the plastic bags within said cavity;

(d) a suspension member connected to said upper element at a rear exterior surface thereof, and generally corresponding said head, and (e) said suspension member being structured to cooperate with a hook member disposed on a substantially vertical structure so as to suspend said receptacle therefrom with said upper member being prevented from falling forward when said receptacle is disposed in a suspended position.

28. To be disposed on a protruding member disposed on a generally vertical structure, A receptacle for plastic bags and other like articles, comprising:

an upper member, said upper member having a general configuration and appearance of a doll and comprising: a head, a torso, and at least one arm;

a lower element, said lower element defining a cavity therein;

said lower element being attached to said upper member and extending downwardly therefrom;

said lower member being structured and disposed to simultaneously define the general shape and configuration of a skirt and to receive and contain in a readily dispensable orientation a plurality of plastic bags;

said plurality of plastic bags being disposed in said cavity;

said lower element further including an opening defined therein and disposed in communication with said cavity;

dispensing means disposed at said opening of said lower element, said dispensing means being structured to contain said plurality of plastic bags within said cavity while allowing facilitated dispensing passage through said opening of at least one of the plastic hags upon affirmative removal by a user;

a suspension member coupled to said upper element, and said suspension member being structured and disposed to cooperate with the protruding member disposed on the substantially vertical structure so as to suspend said upper member and said lower member therefrom in an attractive, generally vertical orientation resembling said general configuration and appearance of said doll.

* * * * *